United States Patent [19]

Bartow

[11] 4,280,592

[45] Jul. 28, 1981

[54] FULL FREE-LIFT UPRIGHT FOR LIFT TRUCK

[75] Inventor: Richard J. Bartow, Athens, Mich.

[73] Assignee: Clark Equipment Company, Buchanan, Mich.

[21] Appl. No.: 28,614

[22] Filed: Apr. 9, 1979

Related U.S. Application Data

[63] Continuation-in-part of Ser. No. 202,099, Oct. 30, 1980, which is a continuation of Ser. No. 17,779, Mar. 8, 1979, abandoned, which is a continuation-in-part of Ser. No. 842,765, Oct. 17, 1977, abandoned.

[51] Int. Cl.[3] ..... B66B 9/20

[52] U.S. Cl. ..... 187/9 E; 414/631

[58] Field of Search ..... 187/9 R, 9 E, 8.59; 414/629, 630, 631, 641; 254/342, 394

[56] References Cited

U.S. PATENT DOCUMENTS

| | | | |
|---|---|---|---|
| 2,770,324 | 11/1956 | Peterson | 187/8.59 |
| 2,855,071 | 10/1958 | Arnot | 187/9 E |
| 3,360,078 | 12/1967 | Hopgold | 187/9 E |
| 3,587,784 | 6/1971 | Tait | 187/9 E |
| 3,830,342 | 8/1974 | Allen | 187/9 E |
| 3,968,859 | 7/1976 | Ehrhardt | 187/9 E |
| 4,030,568 | 6/1977 | Heinold | 187/9 E |

FOREIGN PATENT DOCUMENTS

| | | | |
|---|---|---|---|
| 2020276 | 11/1971 | Fed. Rep. of Germany | 187/9 R |

*Primary Examiner*—Robert J. Spar
*Assistant Examiner*—Kenneth Noland
*Attorney, Agent, or Firm*—J. C. Wiessler

[57] ABSTRACT

A lift truck upright having a fixed upright section, a telescopic upright section, and a load carrier mounted on the latter section. An asymmetric lift cylinder assembly is located adjacent one side of the upright in a position which provides improved overall operator visibility through the upright. The lift cylinder is adapted to be operatively connected to the telescopic upright section by means of lifting chain structure which traverses across the upright and which is reeved on spaced and rotationally aligned sprockets supported from the cylinder assembly, the one chain end structure being connected substantially centrally of the load carrier and the other chain end structure being fixedly secured substantially outwardly of one side of the cylinder assembly. The cylinder assembly is positioned at or near a location which is one-half the projected distance between the chain end connections, or in a broader sense, approximately midway between the vertical central plane of the load carrier and the chain end connection outwardly of the cylinder assembly. It preferably comprises a cylinder assembly supported from the one side of the upright at an elevated position and having an effective stroke of substantially one-half the height of the collapsed upright. In addition a cantilevered cylinder is supported from the telescopic section for elevating thereon the load carrier to the full free-lift position.

10 Claims, 4 Drawing Figures

FULL FREE-LIFT UPRIGHT FOR LIFT TRUCK

CROSS-REFERENCE TO RELATED APPLICATIONS

This application is a continuation-in-part of copending application Ser. No. 202,099, filed October 30, 1980, which is a continuation of Ser. No. 17,779 filed Mar. 8, 1979 now abandoned, which is a continuation-in-part of application Ser. No. 842,765 filed Oct. 17, 1977, now abandoned. The present application is in addition related to my commonly assigned, copending, concurrently filed applications Ser. Nos. 28,292 and 28,308 and to application Ser. No. 176,742, filed Aug. 11, 1980, which is a continuation of Ser. No. 28,291, now abandoned.

BACKGROUND OF THE INVENTION

In lift trucks of the type contemplated it has been one of the most persistent problems encountered in the art over the years to provide an upright construction which both affords the operator of the truck good visibility through the upright and which is of relatively simple and low cost construction. Heretofore various means have been devised for improving operator visibility through telescopic uprights in lift trucks, including upright structures such as are disclosed in U.S. Pat. Nos. 2,394,458, 2,456,320, 2,855,071, 3,394,778, 3,830,342, and German Pat. No. 1,807,169, but none have satisfied adequately the above criteria.

SUMMARY

My present invention relates to an upright type known as a full freelift two stage upright. It provides in such an upright significantly improved operator visibility and relative simplicity and low cost construction. More particularly, it provides an asymmetric lift cylinder assembly operatively connected to the telescopic upright section and located adjacent one side of the upright in such a manner that it projects at least partially into the area of interference by the adjacent side of the upright when in a retracted or collapsed position with the visibility of the operator from his normal line of sight through that side of the upright, and preferably projects partially also into the longitudinal plane of that side of the upright. The cylinder assembly operates a flexible lifting element (chain) which is reeved to traverse across a portion of the upright on a pair of rotationally aligned spaced sheaves or sprockets supported from the end of the piston rod of the lift cylinder. One end of the chain structure, as disclosed, is connected substantially centrally of the telescopic section and the other end structure is connected to a relatively fixed member substantially outwardly of the one side of the cylinder assembly, the cylinder assembly being positioned at or near a location which is one-half the projected distance between the chain end connections. In a broader sense, the cylinder assembly is positioned approximately midway between the vertical central plane of the load carrier and the connection of the flexible element outwardly of the cylinder assembly.

A cantilevered cylinder is mounted substantially centrally of the telescopic section. During elevation of the upright elements the latter cylinder elevates the load carrier to a full free-lift position on the telescopic section prior to the operation of the asymmetric cylinder.

It is an important principle of the invention that the lifting force of the asymmetric cylinder and associated structure apply at least approximately balanced lifting force moments on the upright structure in the transverse plane of the upright.

It is a primary object of the invention to provide improved and novel upright structure for use on a full free-lift two stage upright for lift trucks and the like in which improved operator visibility is provided through the upright.

Another important object is to provide improved operator visibility in such upright structures while providing an upright of relative simlicity and low cost.

Other objects, features and advantages of the invention will readily appear to persons skilled in the art from the detailed description of the invention which follows.

DESCRIPTION OF PREFERRED EMBODIMENT

Figure 1:
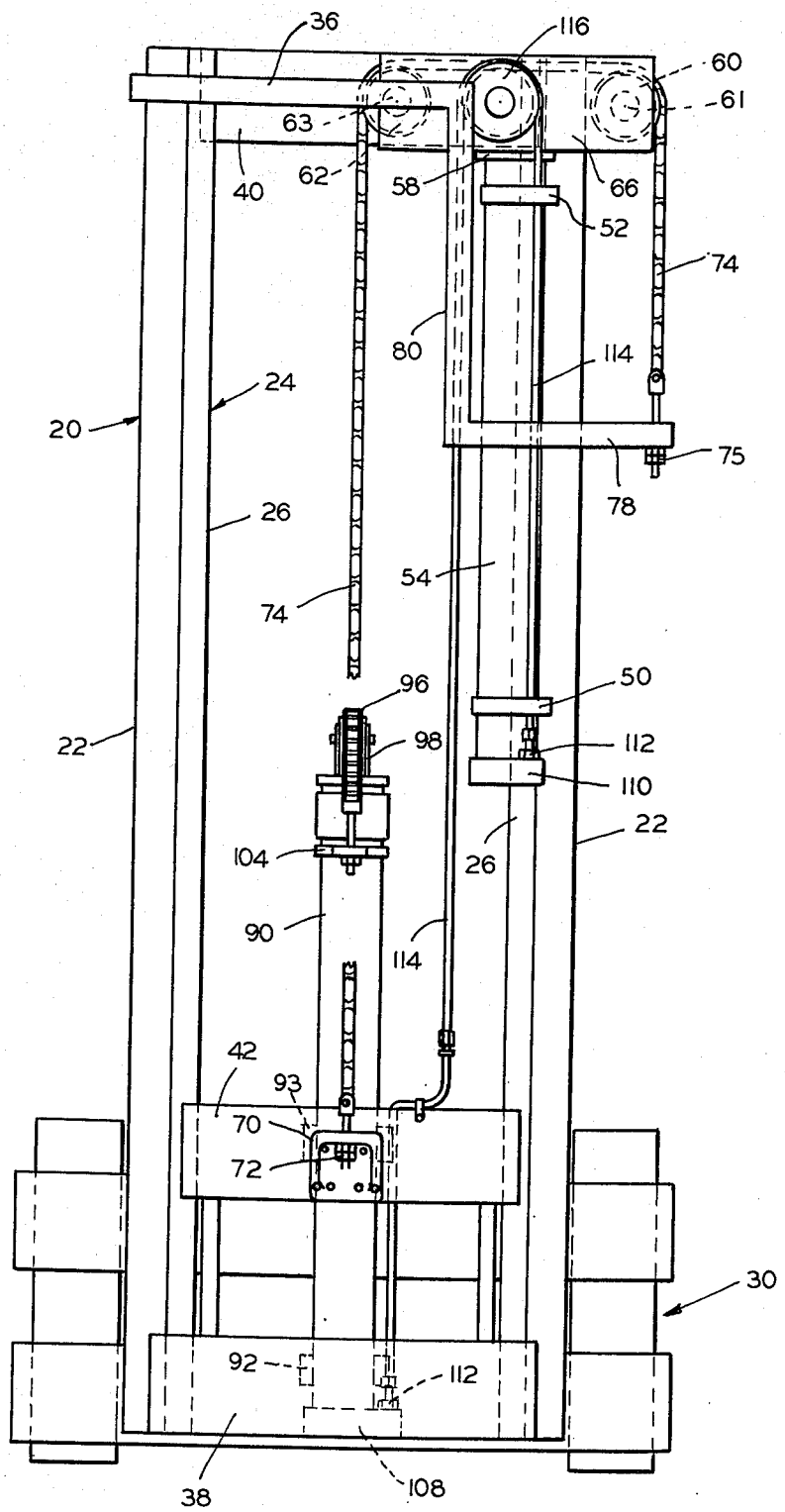
FIG. 1 is a full rear view of a lift truck upright in a collapsed position with the load carrier down.

Referring to the drawing, the upright assembly of the present invention is adapted to be mounted on a lift truck in known manner, such as is shown in above application Ser. No. 17,779. A fixed mast section 20 includes a pair of transversely spaced opposed channel members 22 arranged to receive a single telescopic mast section 24 formed of two laterally spaced I-beams 26, mast section 24 being guide roller supported in mast section 20 and arranged for longitudinal movement relative thereto. A load or fork carrier 30 having a pair of transverse support plates 32 and 34 is guide roller mounted in known manner for elevation in the telescopic upright section. Mast section 20 is cross-braced for rigidity by means of upper and lower transverse brace members 36 and 38, and telescopic section 24 is cross-braced by upper and lower transverse members 40 and 42.

The I-beam mast section 24 is nested within the outer section 20 in known manner such that the forward flanges of the I-beams 26 are disposed outside of and overlapping the forward flanges of channels 22, and the rear flanges of the I-beams are disposed inside the adjacent channel portions and forwardly of the rear flanges of channels 22, pairs of rollers being suitably mounted between said adjacent pairs of the I-beams and channels for supporting the I-beam telescopic section longitudinally and laterally for extensible movement relative to the fixed channel section. Particulars of the nested offset I-beam upright structure, the mounting of the load carrier thereon, and details of structure and mounting of guide and support roller pairs are explained in detail in U.S. Pat. No. 3,213,967.

As illustrated, a pair of vertically spaced plate members 50,52 are secured, as by welding, near the lower and upper ends of a lift cylinder 54 supported in an elevated position as shown, the plate members 50,52 being secured also to the rear flanges of the one channel rail member 22. Mounted rigidly atop the piston rod 56 is a plate member 58. Sprockets 60 and 62 are mounted for rotation on stub shafts 61 and 63 which are journaled at the opposite ends of a pair of longitudinally spaced support plate members 64 and 66 which extend transversely of the upright and are mounted rigidly, as by welding, on the top of plate 58.

A chain anchor block 70 is secured centrally of lower brace 42 to which is secured at anchor 72 one end of a lifting chain 74, or other flexible lifting means, which extends upwardly and over sprockets 60 and 62 and then downwardly to a fixed anchor location 75 located in a predetermined position outwardly of cylinder 54 and adjacent the outer end of a step-down support and brace plate 78 of brace 36, the horizontal end portions of the brace being connected by a vertical plate 80. For convenience in the specification and claims hereof sprocket or sheave (wheel) means will be referred to as "sprocket" or "sprocket means", it being understood that any suitable wheel means for performing a similar function is intended to be included.

Figure 4:
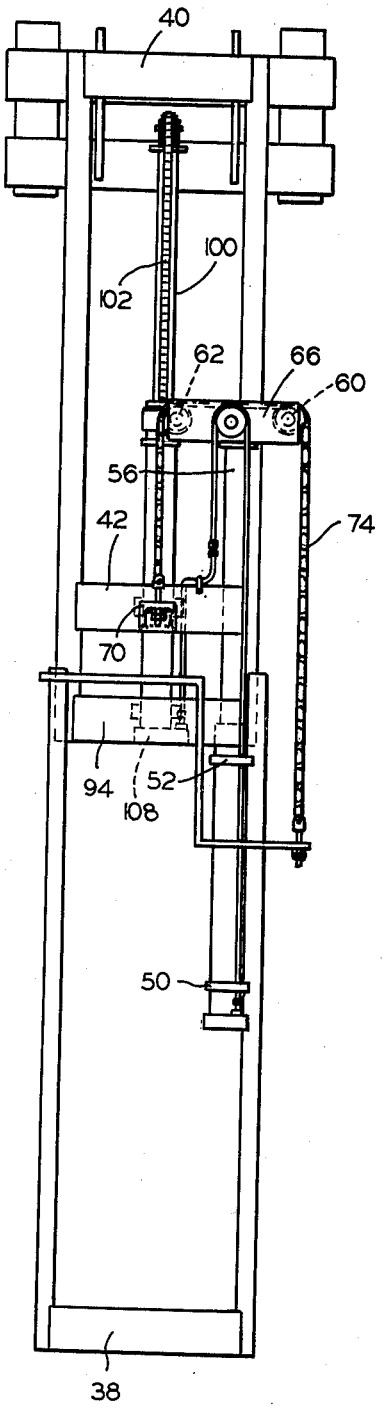
FIG. 4 is a somewhat schematized rear view reduced in scale and showing the upright extended to full elevation.
Figure 3:
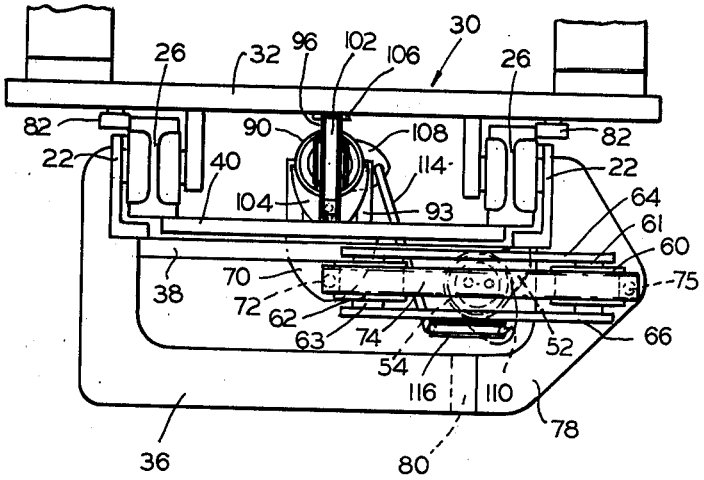
FIG. 3 is a plan view of the upright of FIG. 1.

Cylinder assembly 54 has an effective stroke of substantially one-half the collapsed height of the upright such that from its preferred mounted location as illustrated it is adapted to actuate telescopic section 24 at a 2:1 movement ratio to maximum elevation (FIG. 4). The elevated mounted position of the cylinder assembly enables the upright to be tilted further rearwardly on the lift truck in any given design inasmuch as the cylinder assembly is located substantially out of potential interfering relation with the truck body for example, which would limit available rearward upright tilt.

Although I have shown but a single chain 74, it should be understood that in practice it may well be found preferable for safety reasons to use two or more smaller chains reeved in substantially the same manner as is single chain 74 on modified single sprockets or on multiple side-by-side sprockets as desired. Recitations in the claims of "sole flexible lifting means," and the like, include such side-by-side lifting elements which will perform the same function as does the single lifting element 74 shown in the drawing.

In order to substantially balance the force moments acting in a transverse plane on the embodiment of the upright assembly as disclosed, the connection of the chain to anchor block 70 at 72 should be located at or substantially at the transverse center of carriage 30, and the connection of piston rod 56 to plate 58 in combination with the location of chain anchor 75 should be such that the piston rod is connected to the plate 58 and to support plate members 64 and 66 at or near one-half the distance between the locations of chain anchors 72 and 75. Then, the forces passing through upright sections 20 and 24 create substantially no unbalanced moments or a calculated small unbalanced moment in the transverse plane of the upright, as viewed in FIGS. 1 and 2, for example, because the cylinder assembly is centered or approximately centered transversely between the chain anchors.

As will be understood by persons skilled in the art, in a free body force moment system, the vertically directed forces acting on the upright in the transverse plane with the piston rod centered as aforesaid comprise a one unit force in an upward direction at each chain end, a one unit force in a downward direction in each vertical run of chain, a two unit force directed upwardly at the center of the piston rod connection to plate 58, and a two unit force directed downwardly at the center of the cylinder on supports 50 and 52. Thus, the upright functions in theoretical force moment balance. Of course, such theoretical conditions do not exist in practice, and side thrusts or torque loading on the upright such as result from unbalanced moments effected by off-center loads on the fork, for example, may be resisted by upper and lower pairs of carriage side thrust rollers 82 operating on the outer flange edges of I-beams 26 in known manner.

The designer of uprights of various widths, depths, seat locations, and the like may choose any one of a number of viable combinations of such structure within the scope of my invention. It should therefore be understood that recitations in the claims hereof relating to the substantial or approximate balance of force moments in the upright, or to the asymmetric position of the cylinder substantially or approximately centered between the projected chain anchor locations or the like, shall be interpreted to include a range of positions of the cylinder assembly between the sprockets which best effects the desired result of good operator visibility through the upright and adequately balanced force moments acting on the upright in operation.

The design is such that the location of the cylinder assembly at one side of the upright combines with the location of the operator, preferably offset a predetermined distance to the opposite side of the longitudinal axis of the truck, to provide an operator's line of sight through the upright on the side at which the cylinder assembly is located so that the cylinder assembly interferes a relatively small amount or not at all with the operator's visibility through that side of the upright. In other words, the cylinder assembly projects at least partially into the area of interference by the adjacent side of the upright when in a retracted or collapsed position with the visibility of the operator from his normal line of sight through that side of the upright, and preferably projects partially also into the longitudinal plane of that side of the upright.

References made in the specification and claims hereof to the longitudinal plane of one side of the upright, or of the vertical rails of the upright, shall have the following meaning: The longitudinal plane of the one side of the upright shall mean a vertical plane extending longitudinally of the upright assembly bounded by the outer and inner surfaces of the vertical rail assembly on one side of the upright.

Figure 2:
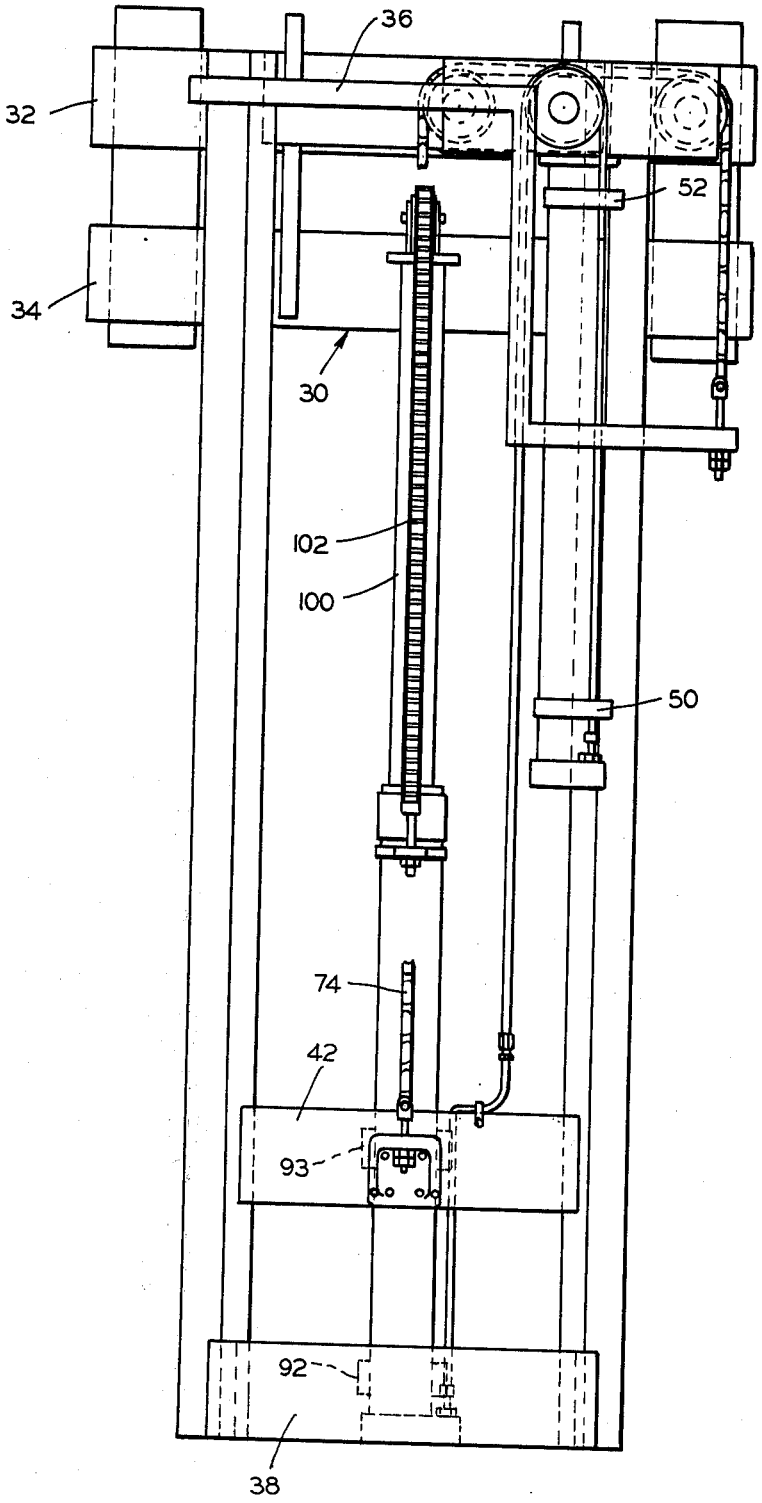
FIG. 2 is a view as shown in FIG. 1 with the load carrier shown in a full free-lift position at extension of the cantilevered cylinder.

A cantilevered lift cylinder assembly 90 is supported centrally of upright section 24 on cantilevered support plates 92 and 93 which are secured on bottom brace plates 42 and 94 of section 24. A single sprocket 96 is mounted for rotation by a bracket 98 at the end of a piston rod 100, a lifting chain 102 being reeved on the sprocket and secured at one end to an anchor plate 104 located on the cylinder, and the opposite end secured centrally of plate 34 of load carriage 30 at an anchor block 106. The lift cylinder 90 is substantially one-half the length of the upright section 24 and when extended actuates the fork carriage at a 2:1 ratio to a full free-lift position as shown in FIG. 2 prior to the elevation of upright section 24 by the cylinder assembly 54,56.

The base plates 108 and 110 extend outwardly from cylinders 90 and 54, respectively, on each of which is mounted a hydraulic fitting 112 which are connected together by a flexible hydraulic conduit 114 suspended from a sheave 116 which is mounted on a stub shaft for rotation from the rear side of support plate 66. The base plates 108 and 110 are adapted to communicate the conduit with respective cylinders through the hydraulic fittings from a source of pressure fluid, not shown, pressure fluid being delivered by the hydraulic system simultaneously to the cylinder assemblies and, as is known, the cylinders operate automatically in the sequence related to the load supported thereby, whereby cylinder 90 functions initially to elevate the load carrier to a full free-lift position as in FIG. 2, whereupon cylinder 54 extends to elevate the upright structure to the FIG. 4 position.

It will be understood by persons skilled in the art that other design variations than those identified herein may be found feasible without departing from the scope of my invention.

For example, although the basic design of the upright disclosed is an offset I-beam roller mounted design, it will be appreciated that the invention may be also used with many other known upright designs, including coplanar (not offset) roller mounted channels or I-beams, fully nested roller mounted I-beams inside of outer channels, non-roller mounted sliding inner channel in outer channel, and the like.

The location of the fixed chain anchor 75 may be varied, such as at different selected vertical locations on the outer rail, or located on an outwardly extending cantilevered anchor support which may be secured to the asymmetric cylinder, or in the case of an upright mounted from certain types of lift trucks without provision for fore and aft tilting thereof, the anchor can be located on the truck frame. In the latter design it may be feasible, of course, to mount the asymmetric cylinder assembly also from the truck frame instead of directly from the fixed upright section.

It may be found feasible in some designs to mount the asymmetric cylinder assembly so that the cylinder 54 elevates on a fixed piston rod 56, in known manner; i.e., by reversing the position of the assemblies as shown, and utilizing the piston rod also as a pressure fluid conduit to the cylinder to be actuated.

Depending upon such things as the axial distance of the operator from the upright, the width of the upright, or the transverse position of the operator when seated or standing in a normal operating position on different lift truck types, the most desirable precise location of the asymmetric cylinder assembly based upon the various factors will be established. As noted previously the most critical combination of factors affecting the selection of a cylinder location is operator visibility and force moment balance on the upright, both of which may be compromised from the ideal within the scope of my invention as required to effect the most desirable combination.

In a relatively wide upright, for example, and with the operator located relatively close to the upright in a forward direction and well off-center to the left thereof, it may be found advantageous to locate the cylinder further forwardly than is shown necessitating a relocation thereof leftwardly and out of the longitudinal plane of the right side of the upright.

However, before the particulars of any given upright design are finalized, it is important to understand that the asymmetric cylinder assembly should be located such that it projects at least partially, and preferably substantially, into the area of interference by the adjacent side of the upright when in a retracted or collapsed position with the visibility of the operator from his normal line of sight through that side of the upright.

Although I have illustrated only one embodiment of my invention, it will be understood by those skilled in the art that modifications, such as are discussed above, may be made in the structure, form, and relative arrangement of parts without departing from the spirit and scope of the invention. Accordingly, I intend to cover by the appended claims all such modifications which properly fall within the scope of my invention.

I claim:

1. In an upright structure for lift trucks and the like having a fixed upright section including transversely spaced vertical rails, a sole telescopic upright section including transversely spaced vertical rails mounted for elevation on said fixed section and elevatable load carrier means mounted for elevation on said telescopic section, the improvement comprising a sole asymmetric lift cylinder assembly mounted in the upright structure which is operatively connected to said telescopic upright section, elongated flexible lifting means operatively connected to said cylinder assembly, to an element fixed in relation to said fixed upright section and to said telescopic section and having a fixed end means thereof secured to said fixed element a substantial distance outwardly of one side only of the cylinder assembly in a direction which includes a lateral component and having the other end means thereof secured to said telescopic section, said cylinder assembly together with said flexible lifting means being adapted to elevate said telescopic section relative to said fixed section, the lift cylinder being located a substantial distance toward one lateral side of the upright structure such that it projects at least partially into the area of interference by an adjacent vertical rail with the visibility of the operator from his normal line of sight through said adjacent vertical rail, said normal line of sight being defined when the operator is located in a predetermined designed position and attitude for normal operation of the lift truck, and a second cylinder assembly for elevating said load carrier means on said telescopic section independently of the elevation of said telescopic section on said fixed section by said asymmetric cylinder assembly, the operative connection of said asymmetric cylinder assembly to said telescopic section in relation to said fixed and other end means being such that at least approximately balanced lifting force moments act on the upright structure in a transverse plane of the upright at least when a load is carried centrally thereof.

2. An upright structure as claimed in claim 1 wherein said asymmetric cylinder assembly projects at least partially into the longitudinal plane of an adjacent vertical rail on the said one side of the upright structure.

3. An upright structure as claimed in claim 1 wherein said asymmetric cylinder is supported from the vertical rail of one side of said fixed upright section.

4. An upright structure as claimed in claim 3 wherein said asymmetric cylinder assembly has an effective stroke of substantially one-half the height of the collapsed upright, said asymmetric cylinder assembly being fixedly supported at an elevated position on said latter vertical rail.

5. An upright structure as claimed in claim 1 wherein inverted U-shaped conduit means connects hydraulically the base ends of the asymmetric and second lift cylinder assemblies, said conduit means being supported from the upper end of the asymmetric cylinder assembly.

6. An upright structure as claimed in claim 5 wherein transversely spaced sprockets are mounted from the upper end of the asymmetric cylinder assembly, said flexible lifting means being reeved on said sprockets.

7. An upright structure as claimed in claim 1 wherein said asymmetric cylinder means is located intermediate said fixed and other end means of said flexible lifting means in such a manner that the lifting force thereof is approximately midway between the central vertical plane of the load carrier means and the effective location of securement of said one end means.

8. In an upright structure for lift trucks and the like having a fixed upright section including transversely spaced vertical rails, a telescopic upright section including transversely spaced vertical rails mounted for elevation on said fixed section and elevatable load carrier means mounted for elevation on said telescopic section, the improvement comprising a lift cylinder assembly mounted in the upright structure asymmetric thereof and operatively connected to said telescopic upright section, first and second sprocket means operatively connected to said lift cylinder assembly, said first and second sprocket means being mounted in substantial longitudinal rotating alignment and spaced relation one to the other, sole flexible lifting means reeved on said first and second sprocket means, said first and second sprocket means being mounted in such a manner that one end of said flexible lifting means is secured substantially centrally of said load carrier means and the other fixed end means is secured a substantial distance outwardly of one side only of the lift cylinder assembly in a direction which includes a lateral component, said lift cylinder assembly being mounted intermediate the axes of rotation of said first and second sprocket means and being actuatable with the sprocket means and said flexible lifting means to elevate said telescopic section on said fixed section, the lift cylinder being located a substantial distance toward one lateral side of the upright structure such that it projects at least partially into the area of interference by an adjacent vertical rail with the visibility of the operator from his normal line of sight through said adjacent vertical rail, said normal line of sight being defined when the operator is located in a predetermined designed position and attitude for normal operation of the lift truck, and a second cylinder assembly for elevating said load carrier means on said telescopic section independently of the elevation of said telescopic section on said fixed section by said asymmetric cylinder assembly.

9. An upright structure as claimed in claim 8 wherein said asymmetric cylinder assembly projects into the vertical plane of said first and second sprocket means.

10. An upright structure as claimed in claim 8 wherein said asymmetric cylinder assembly projects at least partially into the longitudinal plane of said adjacent vertical rail on said one side of the upright structure.

* * * * *